US009360009B2

(12) United States Patent
Coppen

(10) Patent No.: US 9,360,009 B2
(45) Date of Patent: Jun. 7, 2016

(54) MULTI-CHANNEL, ROTARY, PROGRESSING CAVITY PUMP WITH MULTI-LOBE INLET AND OUTLET PORTS

(71) Applicant: AFP Research, LLC, Amesbury, MA (US)

(72) Inventor: Scott William Coppen, Amesbury, MA (US)

(73) Assignee: AFP Research, LLC, Amesbury, MA (US)

( * ) Notice: Subject to any disclaimer, the term of this patent is extended or adjusted under 35 U.S.C. 154(b) by 35 days.

(21) Appl. No.: 13/855,308

(22) Filed: Apr. 2, 2013

(65) Prior Publication Data

US 2013/0302196 A1 Nov. 14, 2013

Related U.S. Application Data

(60) Provisional application No. 61/618,877, filed on Apr. 2, 2012.

(51) Int. Cl.
*F04C 2/16* (2006.01)
*F04C 2/02* (2006.01)
(Continued)

(52) U.S. Cl.
CPC . *F04C 2/02* (2013.01); *F04C 2/107* (2013.01); *F04C 2/165* (2013.01); *F04C 11/001* (2013.01); *F04C 15/0061* (2013.01); *F04C 2250/10* (2013.01)

(58) Field of Classification Search
CPC ..... F01C 1/101; F01C 1/107; F01C 1/16; F01C 1/165; F04C 2/12; F04C 2/107–2/1073; F04C 2/16; F04C 2/165; F04C 11/001; F04C 11/003; F04C 18/107–18/1075; F04C 18/16–18/165; F04C 15/06; F04C 2250/10–2250/102
USPC ..... 418/48, 201.1, 205, 206.1, 206.5, 209, 418/197, 206.4, 196
See application file for complete search history.

(56) References Cited

U.S. PATENT DOCUMENTS 2,410,341 A * 10/1946 Delamere ..... 418/197
3,799,126 A * 3/1974 Park ..... F01C 1/28 123/222

(Continued)

FOREIGN PATENT DOCUMENTS

FR 1199521 A * 12/1959 ..... F04C 2/165
FR 1451633 A * 1/1966 ..... F04C 18/165

(Continued)

*Primary Examiner* — Jesse Bogue
*Assistant Examiner* — Laert Dounis
(74) *Attorney, Agent, or Firm* — Pandiscio & Pandiscio

(57) ABSTRACT

A multi-channel, rotary, progressing cavity pump comprising a housing having an outer wall defined by overlapping cylindrical chambers, a first end wall defining an inlet port, and a second end wall defining an outlet port, said inlet and outlet ports communicating with each chamber; meshed, lobed rotors disposed within said housing and comprising a plurality of lobes having first and second axially-facing end surfaces, said surfaces defining a twist angle, and each lobe defining a helix angle; each rotor being disposed in one chamber of said housing so that a lobe apex sealingly engages the outer wall defined by its associated chamber, and said surfaces sealingly engage said end walls; whereby, when said rotors are rotated in the same direction in unison, (i) an axial progressing cavity is created between said rotors, and (ii) a plurality of peripheral progressing cavities are created between said rotors and said housing.

27 Claims, 16 Drawing Sheets

(51) Int. Cl.

| | |
|---|---|
| ***F04C 2/107*** | (2006.01) |
| ***F04C 11/00*** | (2006.01) |
| ***F04C 15/00*** | (2006.01) |

(56) References Cited

U.S. PATENT DOCUMENTS

| | | | | | |
|---|---|---|---|---|---|
| 3,966,371 | A * | 6/1976 | Berzanske | ..... | 418/197 |
| 4,782,802 | A * | 11/1988 | Koromilas | ..... | 123/246 |
| 4,860,705 | A | 8/1989 | Koromilas | | |
| 8,356,585 | B2 * | 1/2013 | Hathaway | ..... | F01C 1/28 123/242 |
| 2010/0098569 | A1 * | 4/2010 | Robisson et al. | ..... | 418/48 |
| 2010/0329913 | A1 | 12/2010 | Ree | | |
| 2014/0255232 | A1 * | 9/2014 | Kerlin | ..... | F04C 18/165 418/55.2 |

FOREIGN PATENT DOCUMENTS

| | | | |
|---|---|---|---|
| FR | 2367185 | A1 * | 5/1978 |
| JP | 63038695 | A * | 2/1988 |

* cited by examiner

MULTI-CHANNEL, ROTARY, PROGRESSING CAVITY PUMP WITH MULTI-LOBE INLET AND OUTLET PORTS

REFERENCE TO PENDING PRIOR PATENT APPLICATION

This patent application claims benefit of U.S. Provisional Patent Application Ser. No. 61/618,877, filed Apr. 2, 2012 by Scott William Coppen for AXIAL FLOW POSITIVE DISPLACEMENT PUMP, which patent application is hereby incorporated herein by reference.

FIELD OF THE INVENTION

This invention relates to pumps in general, and more particularly to rotary, progressing cavity pumps.

BACKGROUND OF THE INVENTION

Rotary, progressing cavity pumps are well known in the art. In general, these pumps comprise a plurality of meshed, lobed rotors which are rotated in the same direction in unison so as to create a progressing cavity between the meshed, lobed rotors. This progressing cavity can be used to transport flowable matter (e.g., a fluid) along the length of the meshed, lobed rotors. Such rotary, progressing cavity pumps can be useful in many situations, e.g., where it is desirable to ensure that there is no backflow through the pump. However, such rotary, progressing cavity pumps can also suffer from capacity limitations, since flowable matter transfer is limited to the volume of the progressing cavity created between the meshed, lobed rotors.

Thus there is a need for a new and improved rotary, progressing cavity pump having increased pumping capacity.

SUMMARY OF THE INVENTION

The present invention comprises the provision and use of a new and improved rotary, progressing cavity pump having increased pumping capacity.

In one preferred form of the invention, there is provided a novel multi-channel, rotary, progressing cavity pump. The novel multi-channel, rotary, progressing cavity pump comprises a hollow housing having an outer wall defined by a plurality of overlapping cylindrical chambers, a first end wall defining an inlet port, and a second end wall defining an outlet port. The inlet port and the outlet port communicate with each of the overlapping cylindrical chambers of the hollow housing. Preferably, the inlet port and the outlet port are centered on the longitudinal axis of the hollow housing. The novel multi-channel, rotary, progressing cavity pump also comprises a plurality of meshed, lobed rotors which are disposed within the hollow housing, wherein each rotor comprises a plurality of lobes, each lobe having first and second axially-facing end surfaces, the first and second axially-facing end surfaces defining a twist angle, and each lobe defining a helix angle. Each of the meshed, lobed rotors is disposed in one of the overlapping cylindrical chambers of the hollow housing so that a lobe apex substantially sealingly engages the outer wall defined by its associated cylindrical chamber, and the first and second axially-facing end surfaces substantially sealingly engage the first and second end walls, respectively. As used herein, the term "substantially sealingly" (and the like) is meant to indicate that two or more parts make a close sliding fit with one another, whereby to make a true sealing engagement with one another (e.g., a fluid-tight sealing engagement with one another) or a near-sealing engagement with one another.

As a result of this construction, when the meshed, lobed rotors are rotated in the same direction in unison, (i) an axial progressing cavity is created between the meshed, lobed rotors, and (ii) a plurality of peripheral progressing cavities are created external to the meshed, lobed rotors, between the meshed, lobed rotors and the outer wall of the hollow housing. Thus, in the multi-channel, rotary, progressing cavity pump of the present invention, where N meshed lobed rotors are provided within the hollow housing, at least N+1 progressing cavities are created by rotation of the meshed lobed rotors within the hollow housing. By connecting the inlet port to a source of flowable matter (e.g., a fluid), and by rotating the meshed, lobed rotors in the same direction in unison, the axial and peripheral progressing cavities of the multi-channel, rotary, progressing cavity pump can transport the flowable matter along the length of the meshed, lobed rotors. Significantly, because the multi-channel, rotary, progressing cavity pump comprises both an axial progressing cavity and a plurality of peripheral progressing cavities, the multi-channel, rotary, progressing cavity pump provides a pumping capacity significantly greater than that provided by a conventional rotary, progressing cavity pump (which lacks the plurality of peripheral progressing cavities of the present invention).

In one preferred form of the invention, the inlet port and the outlet port each comprise a multi-lobe configuration, wherein the number of lobes in the inlet port, and the number of lobes in the outlet port, is equal to the number of lobed rotors disposed within the hollow housing, whereby to improve the ingress of flowable matter into, and the egress of flowable matter out of, the plurality of peripheral progressing cavities, and hence improve the efficiency of the multi-channel, rotary, progressing cavity pump.

In one preferred form of the present invention, there is provided a multi-channel, rotary, progressing cavity pump, said multi-channel, rotary, progressing cavity pump comprising:

a hollow housing having an outer wall defined by a plurality of overlapping cylindrical chambers, a first end wall defining an inlet port, and a second end wall defining an outlet port, said inlet port and said outlet port communicating with each of said overlapping cylindrical chambers of said hollow housing;

a plurality of meshed, lobed rotors disposed within said hollow housing, wherein each rotor comprises a plurality of lobes, each lobe having first and second axially-facing end surfaces, said first and second axially-facing end surfaces defining a twist angle, and each lobe defining a helix angle;

each of said meshed, lobed rotors being disposed in one of said overlapping cylindrical chambers of said hollow housing so that a lobe apex substantially sealingly engages the outer wall defined by its associated cylindrical chamber, and said first and second axially-facing end surfaces substantially sealingly engage said first and second end walls, respectively;

whereby, when said meshed, lobed rotors are rotated in the same direction in unison, (i) an axial progressing cavity is created between said meshed, lobed rotors, and (ii) a plurality of peripheral progressing cavities are created external to said meshed, lobed rotors, between said meshed, lobed rotors and said outer wall of said hollow housing.

In another preferred form of the present invention, there is provided a method for transporting flowable matter, the method comprising:

providing a multi-channel, rotary, progressing cavity pump, said multi-channel, rotary, progressing cavity pump comprising:

a hollow housing having an outer wall defined by a plurality of overlapping cylindrical chambers, a first end wall defining an inlet port, and a second end wall defining an outlet port, said inlet port and said outlet port communicating with each of said overlapping cylindrical chambers of said hollow housing;

a plurality of meshed, lobed rotors disposed within said hollow housing, wherein each rotor comprises a plurality of lobes, each lobe having first and second axially-facing end surfaces, said first and second axially-facing end surfaces defining a twist angle, and each lobe defining a helix angle;

each of said meshed, lobed rotors being disposed in one of said overlapping cylindrical chambers of said hollow housing so that a lobe apex substantially sealingly engages the outer wall defined by its associated cylindrical chamber, and said first and second axially-facing end surfaces substantially sealingly engage said first and second end walls, respectively;

whereby, when said meshed, lobed rotors are rotated in the same direction in unison, (i) an axial progressing cavity is created between said meshed, lobed rotors, and (ii) a plurality of peripheral progressing cavities are created external to said meshed, lobed rotors, between said meshed, lobed rotors and said outer wall of said hollow housing;

connecting said inlet port to a source of flowable matter; and rotating said meshed, lobed rotors in the same direction in unison.

In another preferred form of the present invention, there is provided a multi-channel, rotary, progressing cavity generator, said multi-channel, rotary, progressing cavity generator comprising:

a hollow housing having an outer wall defined by a plurality of overlapping cylindrical chambers, a first end wall defining an inlet port, and a second end wall defining an outlet port, said inlet port and said outlet port communicating with each of said overlapping cylindrical chambers of said hollow housing;

a plurality of meshed, lobed rotors disposed within said hollow housing, wherein each rotor comprises a plurality of lobes, each lobe having first and second axially-facing end surfaces, said first and second axially-facing end surfaces defining a twist angle, and each lobe defining a helix angle;

each of said meshed, lobed rotors being disposed in one of said overlapping cylindrical chambers of said hollow housing so that a lobe apex substantially sealingly engages the outer wall defined by its associated cylindrical chamber, and said first and second axially-facing end surfaces substantially sealingly engage said first and second end walls, respectively;

said meshed, lobed rotors being configured to rotate in the same direction in unison so that (i) an axial progressing cavity is created between said meshed, lobed rotors, and (ii) a plurality of peripheral progressing cavities are created external to said meshed, lobed rotors, between said meshed, lobed rotors and said outer wall of said hollow housing;

such that when said inlet port is connected to a source of flowing matter, said meshed, lobed rotors will be turned so as to generate mechanical output energy.

In another preferred form of the present invention, there is provided a method for generating mechanical output energy from flowing matter, the method comprising:

providing a multi-channel, rotary, progressing cavity generator, said multi-channel, rotary, progressing cavity generator comprising:

a hollow housing having an outer wall defined by a plurality of overlapping cylindrical chambers, a first end wall defining an inlet port, and a second end wall defining an outlet port, said inlet port and said outlet port communicating with each of said overlapping cylindrical chambers of said hollow housing;

a plurality of meshed, lobed rotors disposed within said hollow housing, wherein each rotor comprises a plurality of lobes, each lobe having first and second axially-facing end surfaces, said first and second axially-facing end surfaces defining a twist angle, and each lobe defining a helix angle;

each of said meshed, lobed rotors being disposed in one of said overlapping cylindrical chambers of said hollow housing so that a lobe apex substantially sealingly engages the outer wall defined by its associated cylindrical chamber, and said first and second axially-facing end surfaces substantially sealingly engage said first and second end walls, respectively;

said meshed, lobed rotors being configured to rotate in the same direction in unison so that (i) an axial progressing cavity is created between said meshed, lobed rotors, and (ii) a plurality of peripheral progressing cavities are created external to said meshed, lobed rotors, between said meshed, lobed rotors and said outer wall of said hollow housing;

such that when said inlet port is connected to a source of flowing matter, said meshed, lobed rotors will be turned so as to generate mechanical output energy; and connecting said inlet port to a source of flowing matter so that said meshed, lobed rotors will be turned so as to generate mechanical output energy.

BRIEF DESCRIPTION OF THE DRAWINGS

These and other objects and features of the present invention will be more fully disclosed or rendered obvious by the following detailed description of the preferred embodiments of the invention, which is to be considered together with the accompanying drawings wherein like numbers refer to like parts, and further wherein.

DETAILED DESCRIPTION OF THE PREFERRED EMBODIMENTS

Figure 1:
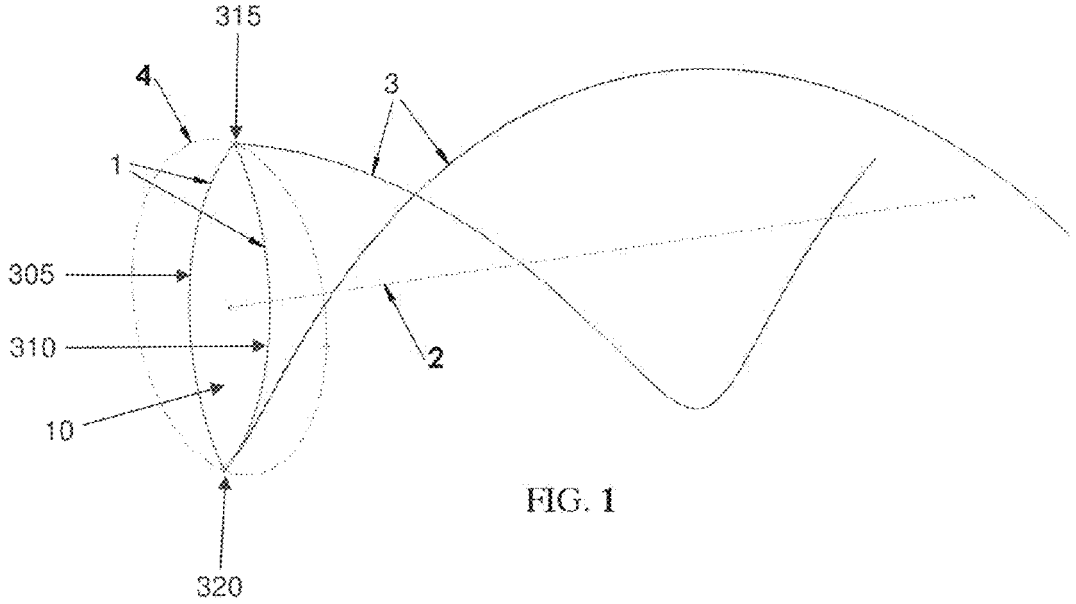
FIG. 1 is an axonometric projection view showing the construction geometry of the rotor profile for a first exemplary multi-channel, rotary, progressing cavity pump of the present invention.

The present invention comprises the provision and use of a new and improved rotary, progressing cavity pump having increased pumping capacity.

In one preferred form of the invention, there is provided a multi-channel, rotary, progressing cavity pump. The novel multi-channel, rotary, progressing cavity pump comprises a hollow housing having an outer wall defined by a plurality of overlapping cylindrical chambers, a first end wall defining an inlet port, and a second end wall defining an outlet port. The inlet port and the outlet port communicate with each of the overlapping cylindrical chambers of the hollow housing. Preferably, the inlet port and the outlet port are centered on the longitudinal axis of the hollow housing. The novel multi-channel, rotary, progressing cavity pump also comprises a plurality of meshed, lobed rotors which are disposed within the hollow housing, wherein each rotor comprises a plurality of lobes, each lobe having first and second axially-facing end surfaces, the first and second axially-facing end surfaces defining a twist angle, and each lobe defining a helix angle. Each of the meshed, lobed rotors is disposed in one of the overlapping cylindrical chambers of the hollow housing so that a lobe apex substantially sealingly engages the outer wall defined by its associated cylindrical chamber, and the first and second axially-facing end surfaces substantially sealingly engage the first and second end walls, respectively.

As a result of this construction, when the meshed, lobed rotors are rotated in the same direction in unison, (i) an axial progressing cavity is created between the meshed, lobed rotors, and (ii) a plurality of peripheral progressing cavities are created external to the meshed, lobed rotors, between the meshed, lobed rotors and the outer wall of the hollow housing. Thus, in the multi-channel, rotary, progressing cavity pump of the present invention, where N meshed lobed rotors are provided within the hollow housing, at least N+1 progressing cavities are created by rotation of the meshed lobed rotors within the hollow housing. By connecting the inlet port to a source of flowable matter (e.g., a fluid), and by rotating the meshed, lobed rotors in the same direction in unison, the axial and peripheral progressing cavities of the multi-channel, rotary, progressing cavity pump can transport the flowable matter along the length of the meshed, lobed rotors. Significantly, because the multi-channel, rotary, progressing cavity pump comprises both an axial progressing cavity and a plurality of peripheral progressing cavities, the multi-channel, rotary, progressing cavity pump provides a pumping capacity significantly greater than that provided by a conventional rotary, progressing cavity pump (which lacks the plurality of peripheral progressing cavities of the present invention).

In one preferred form of the invention, the inlet port and the outlet port each comprise a multi-lobe configuration, wherein the number of lobes in the inlet port, and the number of lobes in the outlet port, is equal to the number of lobed rotors disposed within the hollow housing, and further wherein each lobe extends between two adjacent rotors 10, and communicates with the adjacent overlapping cylindrical chambers 375 which receive those rotors, whereby to facilitate the ingress of flowable matter into, and the egress of flowable matter out of, the plurality of peripheral progressing cavities, and hence to improve the efficiency of the multi-channel, rotary, progressing cavity pump.

Figure 16:
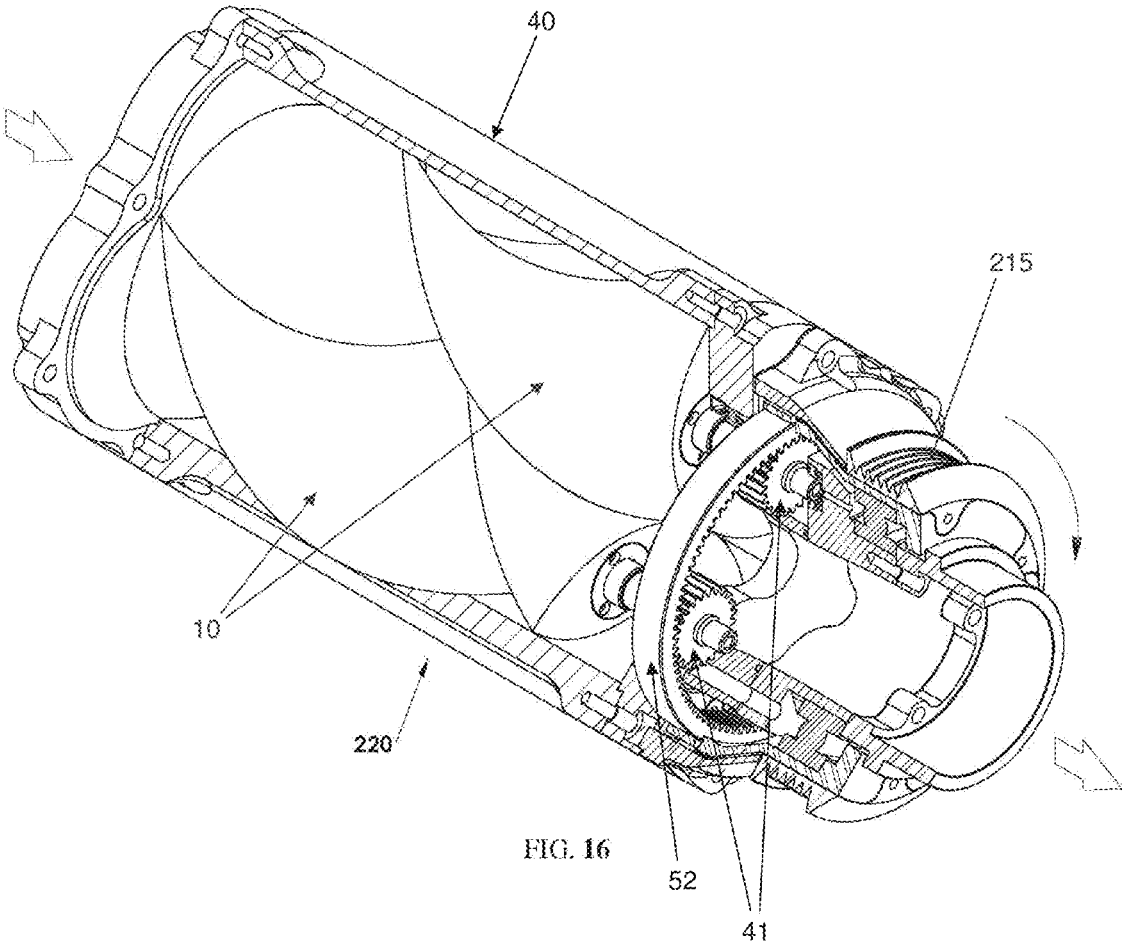
FIG. 16 is an isometric partial cross-sectional view taken along line 16-16 of FIG. 13.

More particularly, and looking now at FIG. 16, there is shown a multi-channel, rotary, progressing cavity pump 220 which is designed to transfer input power (e.g., in the form of mechanical rotational energy transferred through a drive coupling pulley 215) to force flowable matter (e.g., fluid) flow through the pump by the employment of a plurality of synchronized meshed, lobed rotors 10 each having a substantially helical body profile. The meshed, lobed rotor bodies 10 rotate at the same rate, and in the same direction, to define (i) an axial progressing cavity between the meshed, lobed rotors, and (ii) a plurality of peripheral progressing cavities external to the meshed, lobed rotors, between the meshed, lobed rotors and the outer wall of the hollow housing. Inlet and outlet ports, located at opposing ends of the pump, are specifically designed to facilitate fluid flow through the pump. Thus, in the multi-channel, rotary, progressing cavity pump of the present invention, where N meshed lobed rotors are provided within the hollow housing, at least N+1 progressing cavities are created by rotation of the meshed lobed rotors within the hollow housing.

A first exemplary multi-channel, rotary, progressing cavity pump is embodied by the pump 220 shown in FIG. 16.

Figure 17:
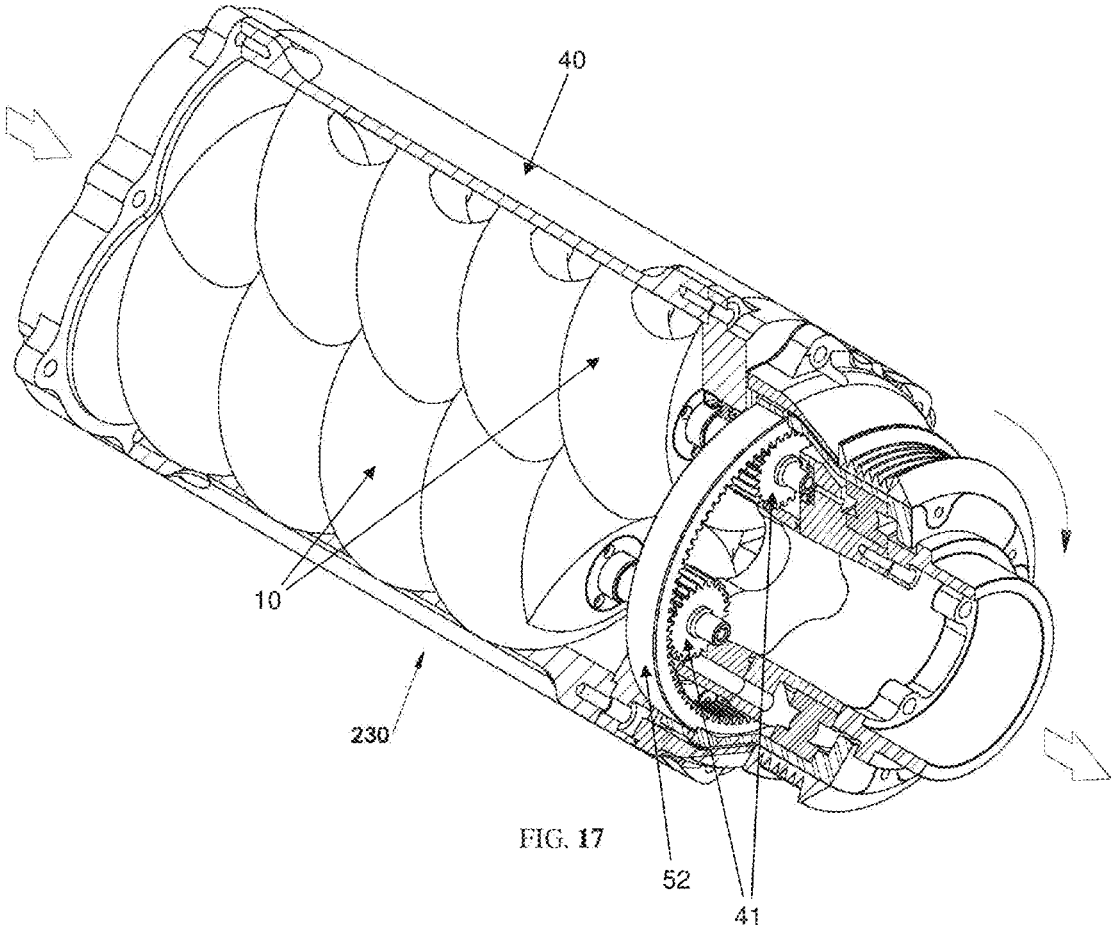
FIG. 17 is an isometric partial cross-sectional view showing a second exemplary multi-channel, rotary, progressing cavity pump of the present invention, taken along the same section as that in FIG. 16.

A second exemplary multi-channel, rotary, progressing cavity pump is embodied by a slow flow pump 230 shown in FIG. 17.

Figure 18:
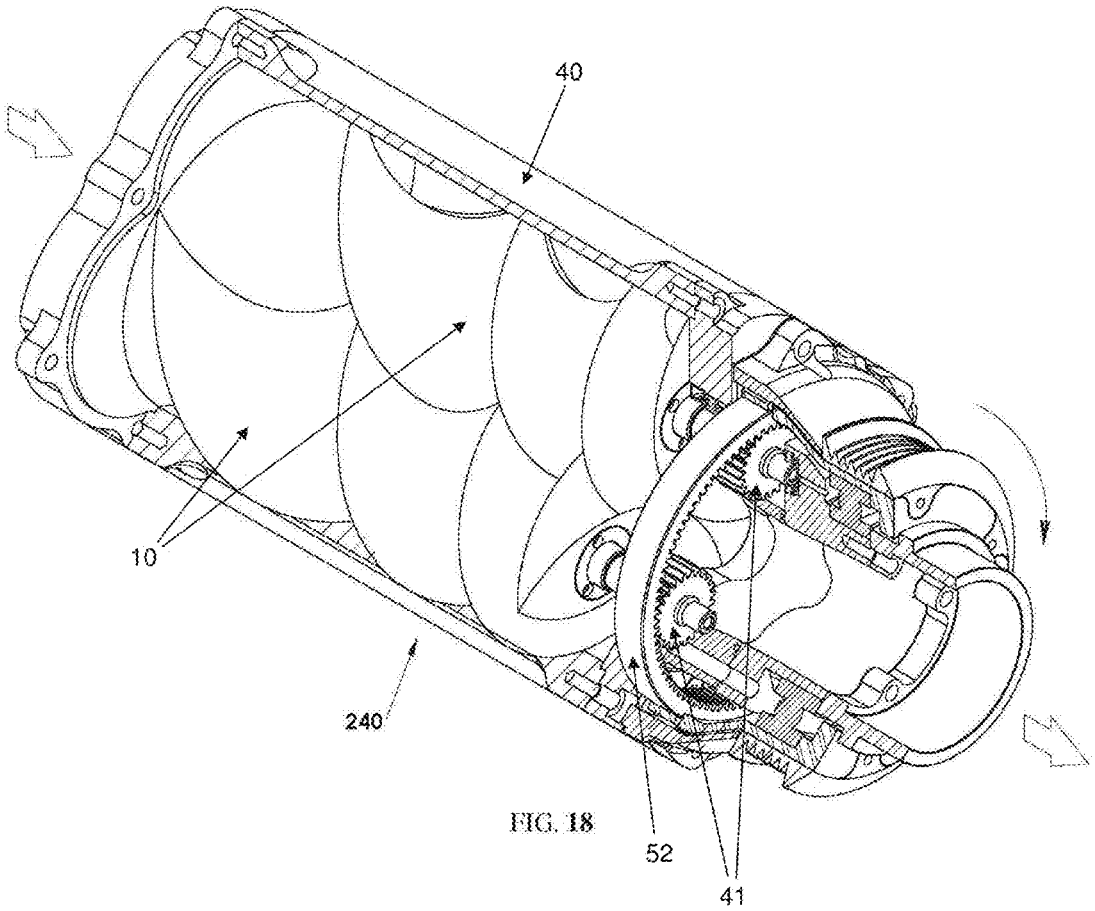
FIG. 18 is an isometric partial cross-sectional view showing a third exemplary multi-channel, rotary, progressing cavity pump of the present invention, taken along the same section as that in FIG. 16.

A third exemplary multi-channel, rotary, progressing cavity pump is embodied by a compressor 240 shown in FIG. 18.

For purposes of clarity, the present invention will first be discussed in the context of the pump 220 shown in FIG. 16.

FIG. 1 shows the primary geometrical profiles and paths that define a lobed rotor 10 of the first exemplary multi-channel, rotary, progressing cavity pump 220. The rotor face profile 1 is defined by two intersecting equal radius coplanar arcs 305, 310 that share coincident end points 315, 320. This region is extruded along the axis 2 of rotor 10, while twisting the region about the rotor axis 2, such that each apex 315, 320 follows a primarily helical apex path 3. The projection of these primarily helical apex paths 3 along the rotor axis 2 defines an apex path axial projection circle 4 that is coincident with the profile arc centerpoints.

Figure 2:
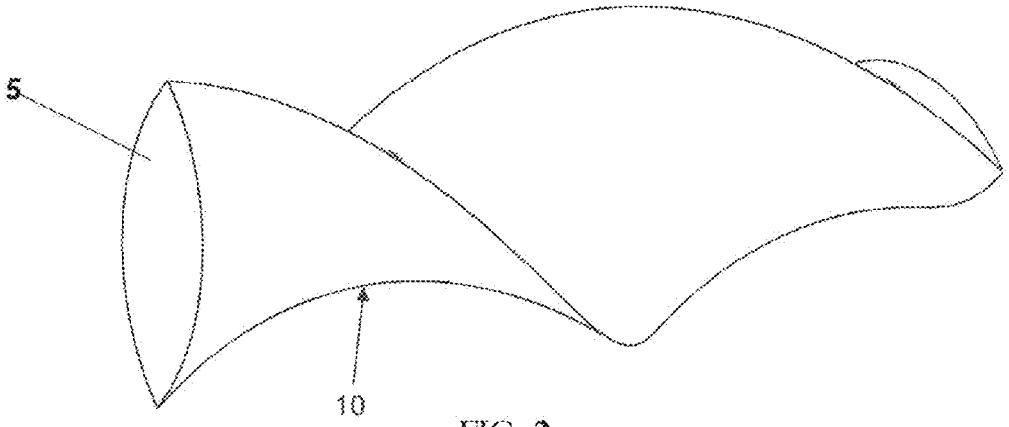
FIG. 2 is an axonometric projection view showing the rotor profile for a first exemplary multi-channel, rotary, progressing cavity pump of the present invention.

FIG. 2 shows the rotor body profile 5 (of the rotor 10) formed by extrusion along the rotor axis 2 and about a primarily helical apex path 3. In the first exemplary multi-channel, rotary, progressing cavity pump 220, the angle of twist about the rotor axis 2 that defines the rotor body profile 5 is 270 degrees.

Figure 3A:
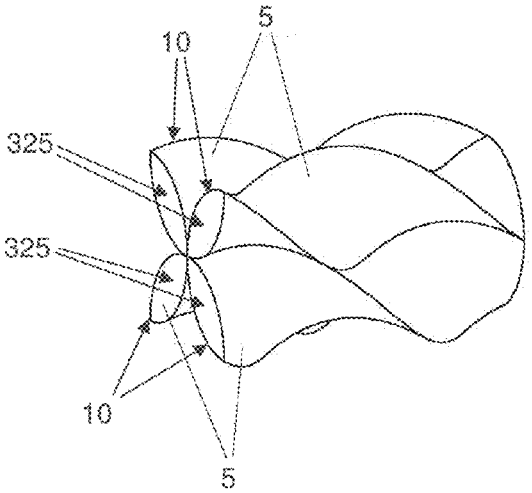
FIG. 3A is an axonometric projection view showing the meshing of multiple rotor profiles shown in FIG. 2 for a first exemplary multi-channel, rotary, progressing cavity pump of the present invention.
Figure 3B:
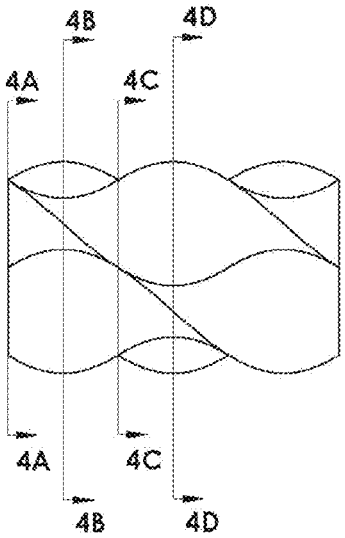
FIG. 3B is a side elevation view showing the meshing of multiple rotor profiles illustrated in FIG. 2 for a first exemplary multi-channel, rotary, progressing cavity pump of the present invention.
Figure 4A:
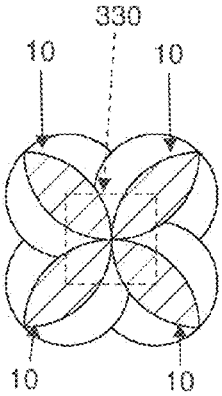
FIG. 4A is a cross-sectional view taken along line 4A-4A of FIG. 3B.
Figure 4B:
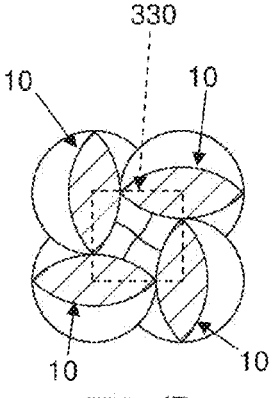
FIG. 4B is a cross-sectional view taken along line 4B-4B of FIG. 3B.
Figure 4C:
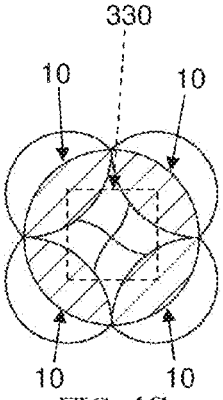
FIG. 4C is a cross-sectional view taken along line 4C-4C of FIG. 3B.
Figure 4D:
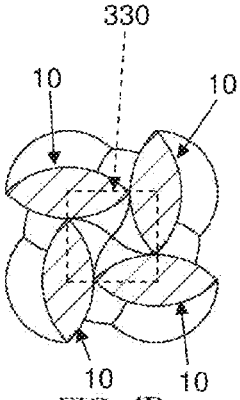
FIG. 4D is a cross-sectional view taken along line 4D-4D of FIG. 3B.

FIGS. 3A and 3B show the arrangement of the rotor body profiles 5 (of the rotors 10) for proper meshing so as to produce a variably positioned and sized region along the rotor axis 2 (i.e., the aforementioned axial progressing cavity). The end faces 325 of each rotor 10 are aligned in a coplanar fashion. The position of the rotor axis 2 for each rotor 10 is located at the corners of a virtual square 330 (FIG. 4A) that is defined parallel to the end faces of the rotors 10. The size of the virtual square 330 is defined such that the apex path axial projection circle 4 of each rotor body profile 5 passes through the geometric center point of the virtual square 330 (FIG. 4A). The angle of each rotor body profile 5 is rotated 90 degrees with respect to the neighboring rotor body profile 5 as defined along the edge of virtual square 330 (see FIG. 4A).

FIGS. 4A-4D show the cross-sectional views of the section lines detailed in FIG. 3B. The enclosed volume between the meshed, lobed rotors 10 is manipulated through synchronous rotation of the rotors, which results in an axial progressing cavity between the rotating rotors which can produce a pumping action in the axial direction. In other words, when the meshed, lobed rotors 10 are rotated in the same direction in unison, an axial progressing cavity is created between the meshed, lobed rotors, and this axial progressing cavity passes down the length of the parallel, rotating rotors 10.

Figure 5:
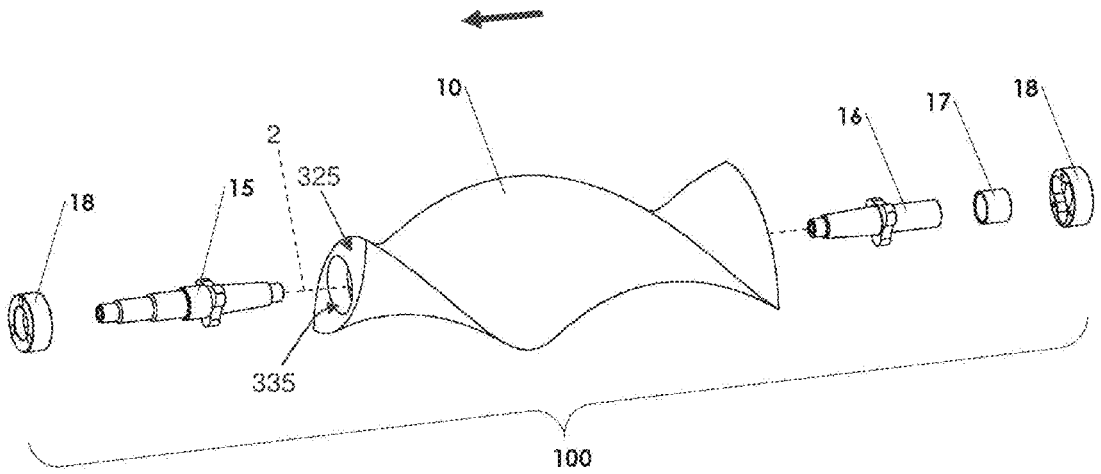
FIG. 5 is an axonometric projection exploded view showing the rotor assembly for a first exemplary multi-channel, rotary, progressing cavity pump of the present invention.

FIG. 5 shows the exploded view of a rotor assembly 100 which comprises a rotor 10 that has been bored at 335 along the rotor axis 2 to accept a rotor shaft 16 at the intake end of rotor body 10 and a rotor shaft 15 at the exhaust end of rotor body 10. Each rotor shaft 15, 16 is secured to rotor body 10 with a rotor shaft lock collar 18 disposed at each end face 325 of rotor body 10. The intake rotor shaft 16 is designed to accept a rotor shaft thrust sleeve 17 that is used to ensure a tight rotational fit of the rotor within the housing.

Figure 6:
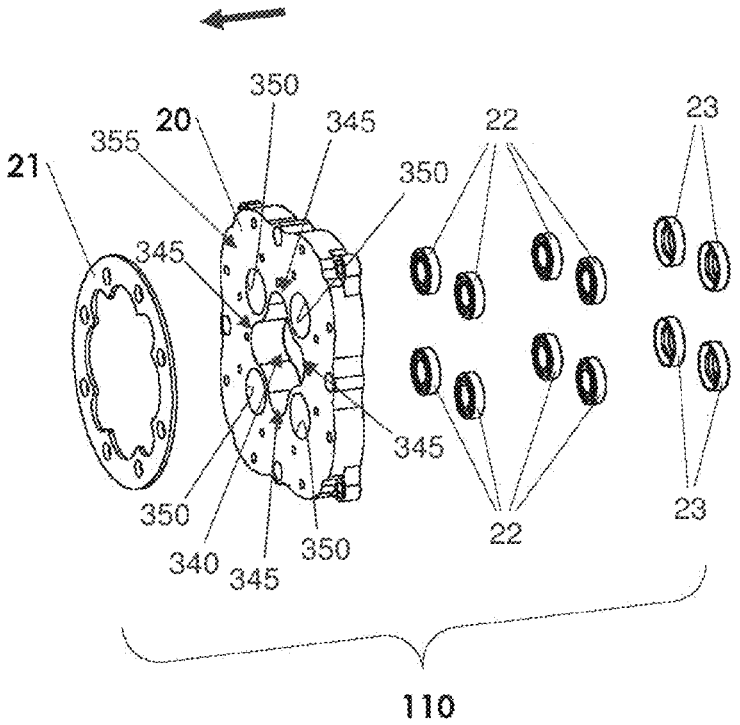
FIG. 6 is an axonometric projection exploded view showing the exhaust block plate assembly for a first exemplary multi-channel, rotary, progressing cavity pump of the present invention.

FIG. 6 shows the exploded view of an exhaust block plate assembly 110 which forms the wall at the exhaust end of the pump (i.e., the aforementioned second end wall defining an outlet port). Exhaust block plate assembly 110 includes a centrally located port opening 340 to permit outlet flow from the pump. Centrally located port opening 340 comprises a plurality of lobes 345. The number of lobes 345 is equal to the number of rotors 10 provided in the pump. Lobes 345 are oriented so that each lobe extends between two adjacent rotors 10, as will hereinafter be discussed in further detail. Exhaust block plate assembly 110 provides bored holes 350 for receivably mounting exhaust block plate bearings 22 and exhaust block plate seals 23, which together define the positioning of the rotor shaft 15 at the exhaust end of rotor assembly 100. An exhaust block plate bearing retainer 21 is fastened to the exhaust block plate 20 so as to limit the position of the exhaust block plate bearings 22 up to the outside face 355 of exhaust block plate 20.

Figure 7:
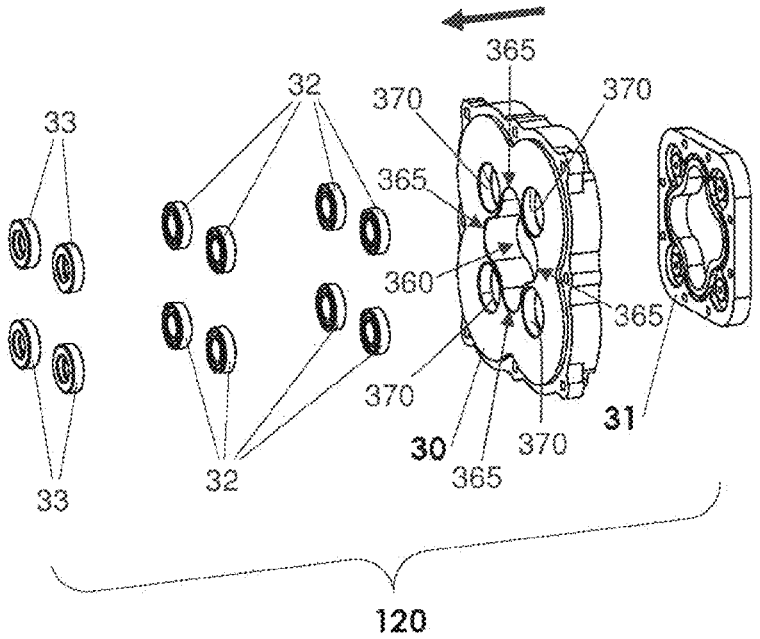
FIG. 7 is an axonometric projection exploded view showing the intake block plate assembly for a first exemplary multi-channel, rotary, progressing cavity pump of the present invention.

FIG. 7 shows the exploded view of an intake block plate assembly 120 which forms the wall at the intake end of the pump (i.e., the aforementioned first end wall defining an inlet port). Intake block plate assembly 120 includes an intake block plate 30 having a centrally located port opening 360 to permit inlet flow into the pump. Centrally located port opening 360 comprises a plurality of lobes 365. The number of lobes 365 is equal to the number of rotors 10 provided in the pump. Lobes 365 are oriented so that each lobe extends between two adjacent rotors 10, as will hereinafter be discussed in further detail. Thus, lobes 365 in intake block plate 30 are aligned with lobes 345 in exhaust block plate 20. Intake block plate assembly 120 provides bored holes 370 for mounting intake block plate bearings 32 and intake block plate seals 33, which together define the positioning of the rotor shaft 16 at the intake end of rotor assembly 100. An intake block plate bearing retainer 31 is fastened to intake block plate 30 so as to limit the position of intake block plate bearings 32 up to the outside face (not shown in FIG. 7) of intake block plate 30, as well as to provide the inlet lubrication fluid passages 400 (see below).

Figure 8:
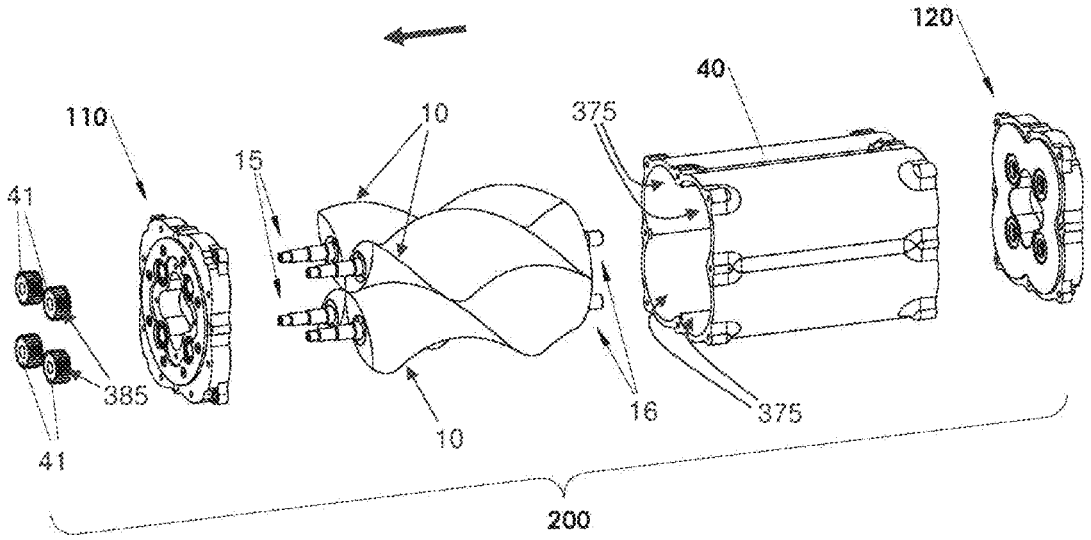
FIG. 8 is an axonometric projection exploded view showing the pump body assembly for a first exemplary multi-channel, rotary, progressing cavity pump of the present invention, wherein the view includes the collapsed display state of the exploded assemblies shown in FIGS. 5-7.

FIG. 8 shows an exploded view of a pump body assembly 200 which serves as the main assembly that translates mechanical rotational energy into pressurized fluid flow. A set of 4 meshed, lobed rotor assemblies 100 is configured in the first exemplary pump, with those 4 meshed, lobed rotor assemblies being arranged according to the meshing scheme shown in FIGS. 3A, 3B and 4A-4D. The rotors 10 in rotor assemblies 100 are housed within a hollow rotor housing 40 that substantially sealingly cooperates with the lobe apexes of the rotor bodies 10. More particularly, rotor housing 40 comprises a plurality of overlapping cylindrical chambers 375 which extend along the length of hollow rotor housing 40, parallel to the axis of rotors 10. Each of the lobed rotors 10 is disposed in one of the overlapping cylindrical chambers 375 in hollow rotor housing 40 so that a lobe apex substantially sealingly cooperates with its associated cylindrical chamber as the lobed rotor 10 is rotated within its associated overlapping cylindrical chamber 375 in hollow rotor housing 40. Exhaust block plate assembly 110 and intake block plate assembly 120 define the end walls of the hollow rotor housing 40. The length of hollow rotor housing 40 is related to the length of the rotor assemblies 100 in the axial direction, so that the axially-facing ends 325 of the rotors 10 substantially sealingly cooperate with the inner faces of the end walls, i.e., the inner faces of exhaust block plate 20 and intake block plate 30. Note that lobes 345 in exhaust block plate 20, and lobes 365 in intake block plate 30, are oriented so that each lobe extends between two adjacent rotors 10. In this way, each lobe 365 in intake block plate 30 can pass flowable matter (e.g., a fluid) into two adjacent overlapping cylindrical chambers 375, and each lobe 345 in exhaust block plate 20 can receive flowable matter (e.g., a fluid) from two adjacent overlapping cylindrical chambers 375. A portion of the rotor shaft 15 at the exhaust end of rotor assembly 100 protrudes through exhaust block plate assembly 110 and is fitted with a rotor gear 41 that is used to control the angular disposition of the associated rotor assembly 100 about its rotation axis. In other words, rotor gear 41 allows rotor assembly 100 to be rotated about its axis.

Figure 9:
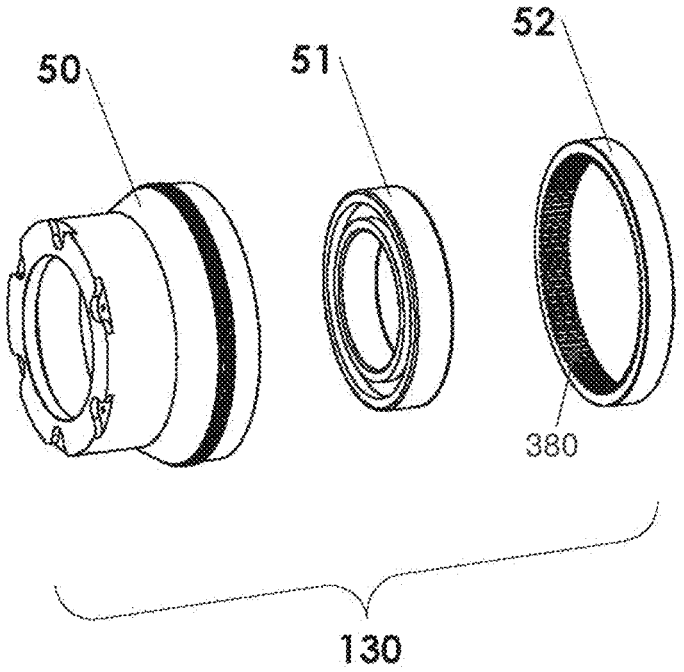
FIG. 9 is an axonometric projection exploded view showing the drive coupling assembly for a first exemplary multi-channel, rotary, progressing cavity pump of the present invention.

FIG. 9 shows an exploded view of a drive coupling assembly 130 which serves to synchronously transfer mechanical rotational energy to the rotor assemblies 100. More particularly, a drive coupling 50 serves as the rigid member that concentrically aligns a drive coupling bearing 51 to a drive coupling gear 52. The teeth 380 of drive coupling gear 52 mesh with the teeth 385 of rotor gears 41 (FIG. 8) so as to synchronously rotate all of the rotor assemblies 100 in the same direction about their axes. In other words, by rotating drive coupling 50 about its axis, drive coupling gear 52 and rotor gears 41 will cause rotor assemblies 100 to synchronously rotate about their respective axes.

Figure 10:
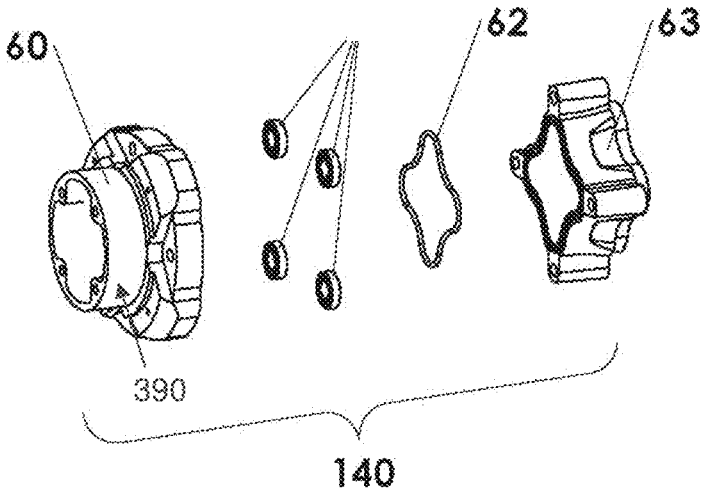
FIG. 10 is an axonometric projection exploded view showing the ported drive coupling mount assembly for a first exemplary multi-channel, rotary, progressing cavity pump of the present invention.

FIG. 10 shows an exploded view of a ported drive coupling mount assembly 140 that functions as a mounting for drive coupling bearing 51 with respect to rotor gears 41 while providing a centrally located port opening to permit the pump outlet flow. More particularly, ported drive coupling mount assembly 45 comprises a ported drive coupling mount 60 having a boss 390 on one end for alignment with the inner bore of drive coupling bearing 51, and having pockets on the other end (not shown in FIG. 10) to accept rotor shaft coupling mount bearings 61 that align with the axes of rotor assemblies 100. Ported drive coupling mount assembly 45 also comprises an exhaust header 63 which aligns with the port opening of ported drive coupling mount 60 and is sealed by the exhaust header seal 62.

Figure 11:
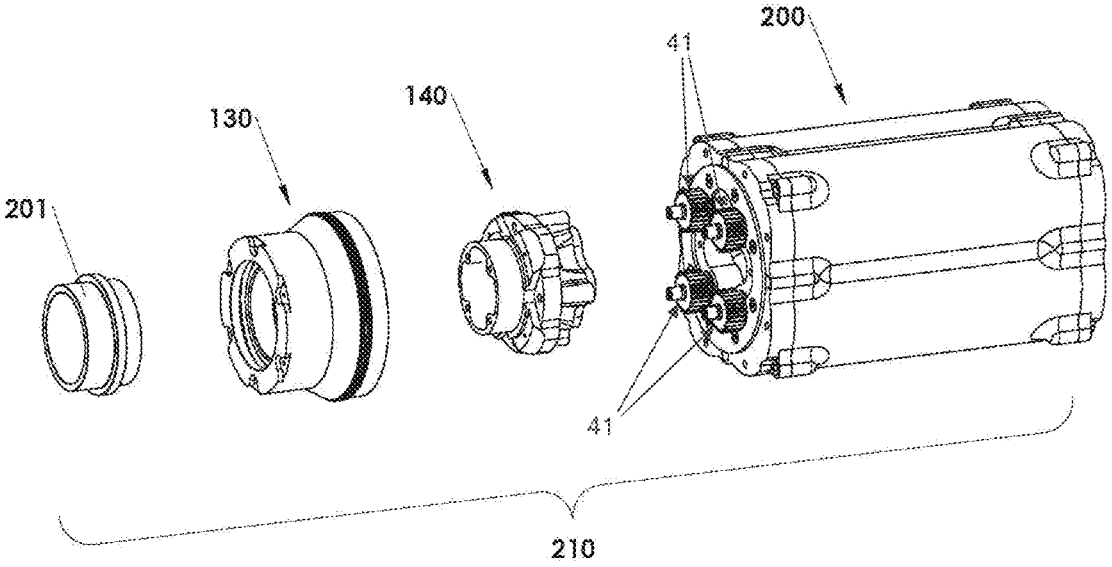
FIG. 11 is an axonometric projection exploded view showing the uncovered pump assembly for a first exemplary multi-channel, rotary, progressing cavity pump of the present invention, wherein the view includes the collapsed display state of the exploded assemblies shown in FIGS. 8-10.

FIG. 11 shows an exploded view of the uncovered pump assembly 210 that details the mounting relationship and alignment of drive coupling gear 52 (contained within drive coupling assembly 130) to properly mesh with rotor gears 41 affixed to the rotor assemblies 100. More particularly, the end boss 390 of ported drive coupling mount assembly 140 provides for the mounting of drive coupling bearing 51 of drive coupling assembly 130. The alignment of ported drive coupling mount assembly 140 to rotor assemblies 100 is provided through the mating of the rotor shaft coupling mount bearings 61 (FIG. 10) that accept the ends of the rotor shafts 15 at the exhaust end of the rotor assemblies 100. The parallel end planes of exhaust header 63 (FIG. 10) ensures that the rotation axis of drive coupling bearing 51 is parallel to the axes of rotation of rotor assemblies 100. Thus, this proper alignment of drive coupling bearing 51 ensures that the pitch diameter of drive coupling gear 52 is coincident with, and tangent to, the pitch diameters of rotor gears 41 for proper gear meshing, whereby to synchronize the rotation of rotor assemblies 100. A ported drive coupling bearing retainer 201 is fastened to drive coupling assembly 130 and provides a circumferential shoulder that is used to retain drive coupling bearing 51 on ported drive coupling mount assembly 140. The position of drive coupling assembly 130 along the axis of rotation can be adjusted through the use of shims (not shown) between the face of the drive coupling bearing 51 that mates with the corresponding bearing face surface provided on the ported drive coupling mount assembly 140.

Figure 12:
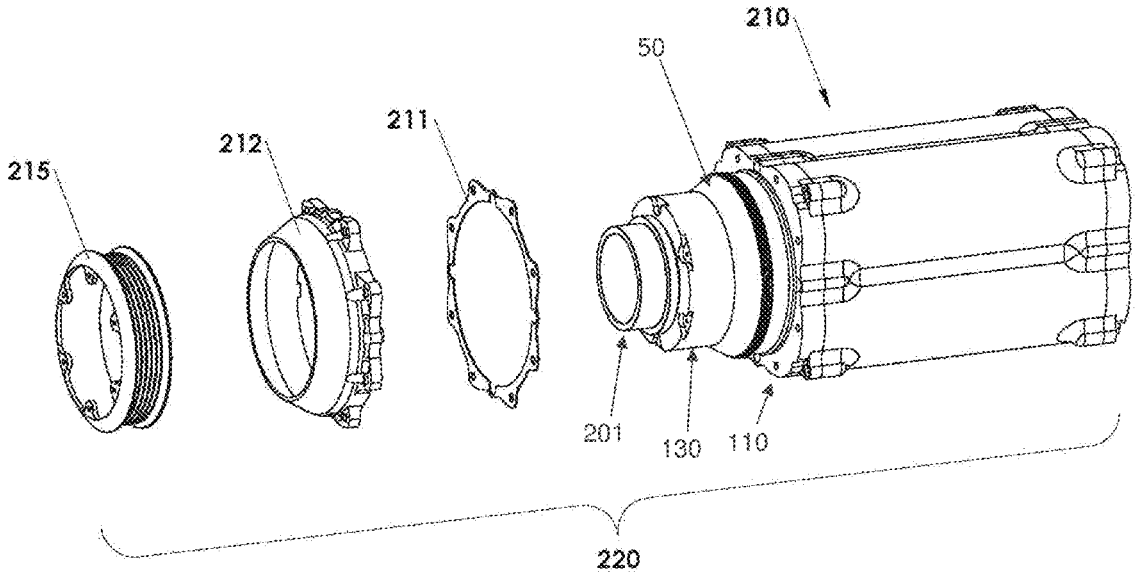
FIG. 12 is an axonometric projection exploded view showing the pump assembly for a first exemplary multi-channel, rotary, progressing cavity pump of the present invention, wherein the view includes the collapsed display state of the exploded assembly shown in FIG. 11.

FIG. 12 shows an exploded view of pump assembly 220 that comprises the top-level assembly of the first exemplary multi-channel, rotary, progressing cavity pump. The portion of drive coupling assembly 130 nearest to exhaust block plate assembly 110 of the uncovered pump assembly 210 is enclosed by a drive coupling cover 212. A drive coupling cover gasket 211 provides a sealing function between the fastening of drive coupling cover 212 to the outward face of exhaust block plate assembly 110. A drive coupling pulley 215 is fastened to drive coupling 50 of drive coupling assembly 130 and provides a ribbed surface for a mating belt to ride in, whereby to transmit mechanical rotational power to the pump assembly 220.

Figure 13:
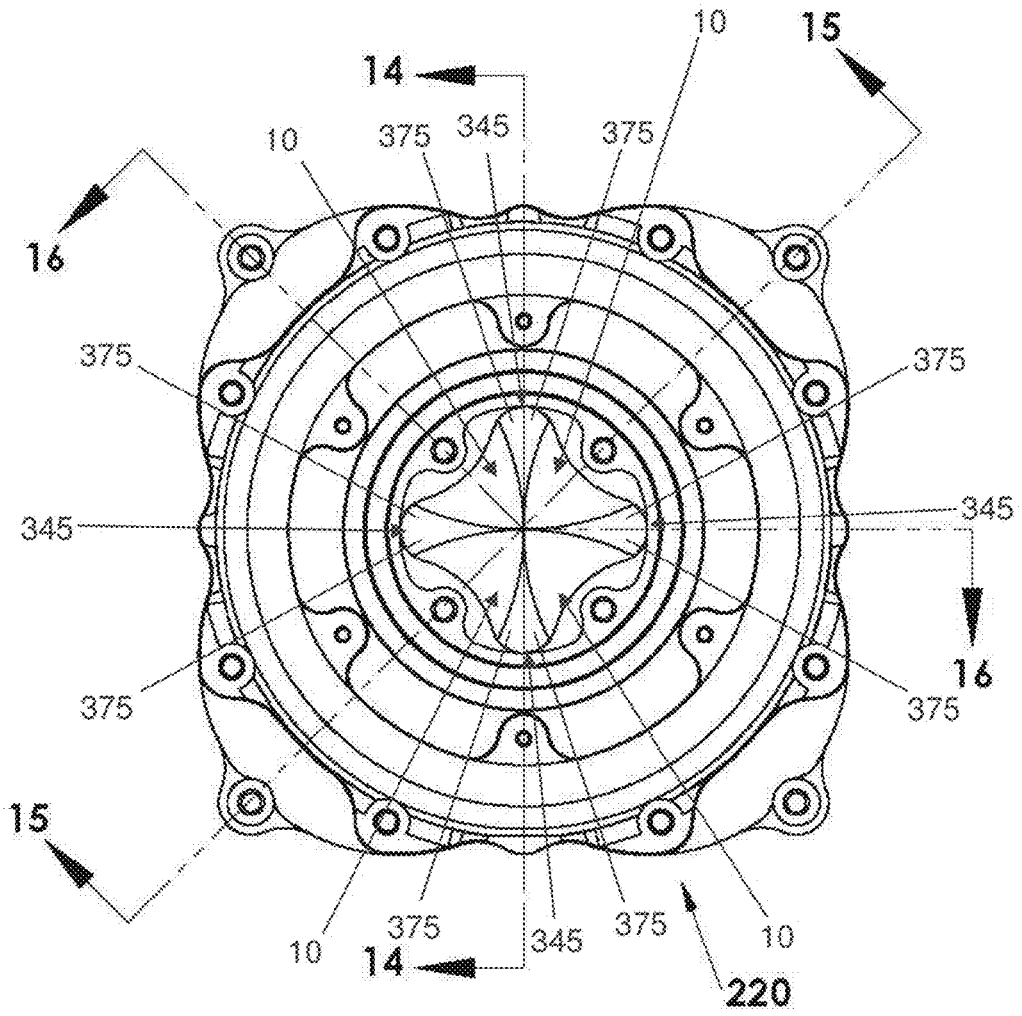
FIG. 13 is a front showing the outlet side view of the pump for a first exemplary multi-channel, rotary, progressing cavity pump of the present invention.
Figure 14:
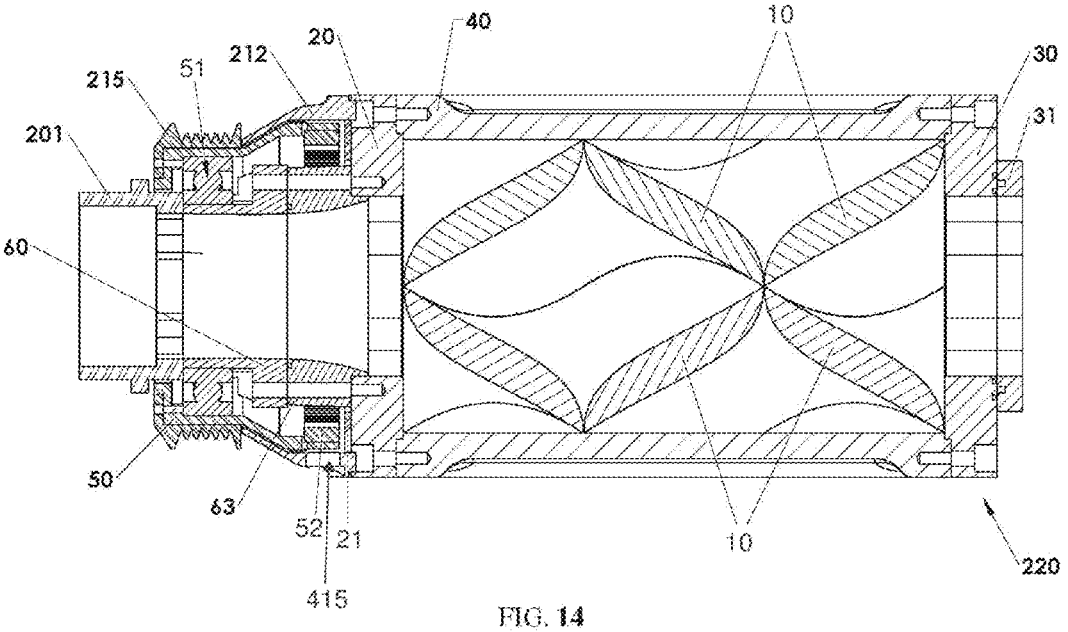
FIG. 14 is a cross-sectional view taken along line 14-14 of FIG. 13.
Figure 15:
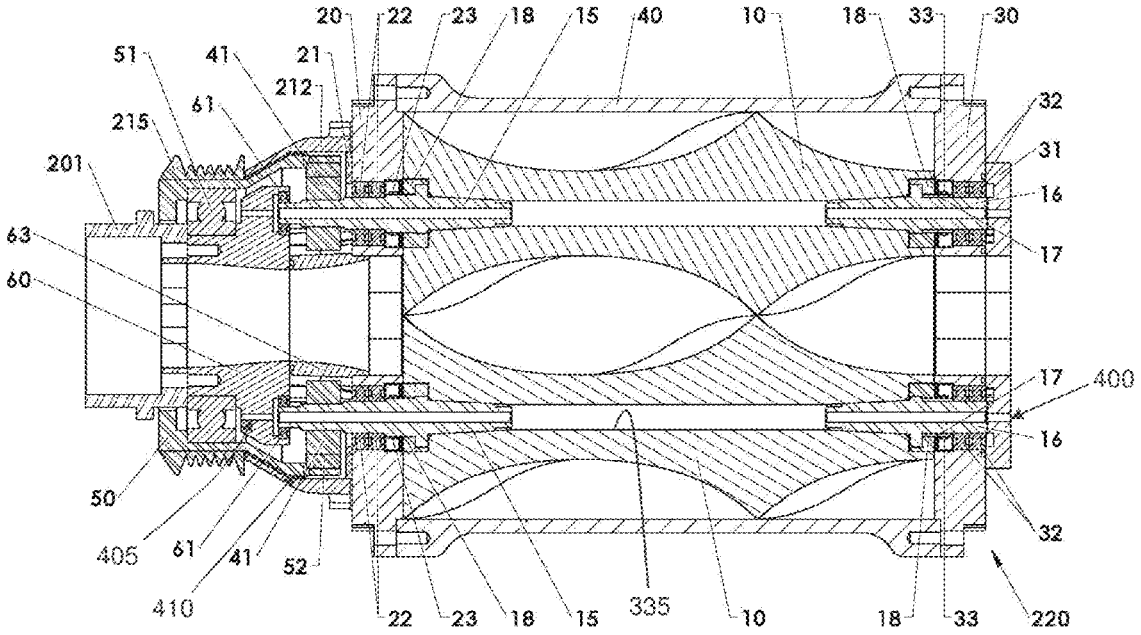
FIG. 15 is a cross-sectional view taken along line 15-15 of FIG. 13.

FIG. 13 an elevational view of pump assembly 220, looking from the exhaust (outlet) end of the pump toward the intake (inlet) end of the pump. The section lines that define the cross-sectional views shown in FIGS. 14-16 are illustrated in FIG. 13. Note how lobes 345 in exhaust block plate 20 are oriented so that each lobe extends between two adjacent rotors 10, and how each lobe 345 communicates with the two adjacent overlapping cylindrical chambers 375 which receive those rotors 10. It should be appreciated that at the intake (inlet) end of the pump, lobes 365 in intake block plate 30 are oriented so that each lobe extends between two adjacent rotors 10, and each lobe 345 communicates with the two adjacent overlapping cylindrical chambers 375 which receive those rotors 10.

FIG. 14 shows a cross-sectional view of pump assembly 220 in order to provide enhanced detail of the components and assembly thereof. It should be noted that the cross-section views of rotor assemblies 100 is variable, since the rotors rotate in synchronization, and hence the view shown in FIG. 14 is merely a representative cross-sectional view of the rotors at a particular angle or phase of pumping action. Rotor assemblies 100 substantially sealingly cooperate (i) with one another, (ii) with the surrounding rotor housing 40 (i.e., with the outer wall of each overlapping cylindrical chamber 375), and (iii) with exhaust block plate 20 and intake block plate 30, whereby to provide the aforementioned axial progressing cavity and the aforementioned plurality of peripheral progressing cavities, as meshed lobed rotors 10 are rotated within hollow housing 40.

FIG. 15 shows another cross-sectional view of pump assembly 220 in order to provide enhanced detail of the components and assembly thereof. The cross-sectional view of FIG. 15 is taken through the axis of rotation of two diagonally-opposed rotors as detailed in FIG. 13, whereby to reveal the rotor cores. It should be noted that the design of rotor assemblies 100 is such that the rotor axis comprises a bore 335, and this bore 335 permits the flow of lubrication fluid through rotor 10. The path of the lubrication fluid starts external to pump assembly 220 at the outer face of intake block plate bearing retainer 31. The lubrication fluid is pumped through small holes 400 cut through the intake block plate bearing retainer 31 along the axes of rotor assemblies 100 and travels through rotor shaft 16 at the intake end of rotor body 10, through bore 335 in rotor 10, and through rotor shaft 15 at the exhaust end of rotor body 10. A portion of the lubricating fluid passes through the small space between the end of rotor shaft 16 at the intake end of the rotor body and the intake block plate bearing retainer 31, where it serves as lubrication for the intake block plate bearings 32. The remaining portion of the lubricating fluid passes through the rotor shaft 15 at the exhaust end of rotor body 10, where a portion of it lubricates the rotor shaft coupling mount bearings 61 and is liberated as small droplets as it passes through the bearing. The remaining portion of the lubrication fluid that exits from the rotor shaft 15 at the exhaust end of rotor body 10 is forced through small holes 405 cut through the ported drive coupling mount 60 along the axis of the rotor assemblies 100 where it lubricates the drive coupling bearing 51 and is liberated as small droplets as it comes in contact with the bearing rolling elements. The liberated droplets of lubricating fluid fill the space between the ported drive coupling mount 60 and the drive coupling 50, where it provides lubrication to the interface of the drive coupling gear 52 and the rotor gears 41 as well as the exhaust block plate bearings 22. As the lubricating fluid mist is deposited on the drive coupling 50, the centrifugal force (due to rotation) forces the lubricating fluid through the small passage holes cut radially through the drive coupling 50, where it is contained within the pump assembly 220 by the drive coupling cover 212. The threaded feature 410 on the external surface of the drive coupling 50 acts as a labyrinth seal that keeps the lubricating fluid from escaping within the gap between the drive coupling 50 and the drive coupling cover 212 near the drive coupling pulley 215. A tapered threaded hole 415 cut through the lower portion of the drive coupling cover 212 provides an outlet for the lubricating fluid where it can filtered and cooled before it is pumped back into the inlet 400 that feeds the intake block plate bearing retainer 31.

FIG. 16 shows a partial cross-sectional view of the pump assembly 220 to provide enhanced detail of the components and assembly thereof. The figure indicates the direction of input pulley rotation that produces the illustrated fluid flow.

Figure 16A:
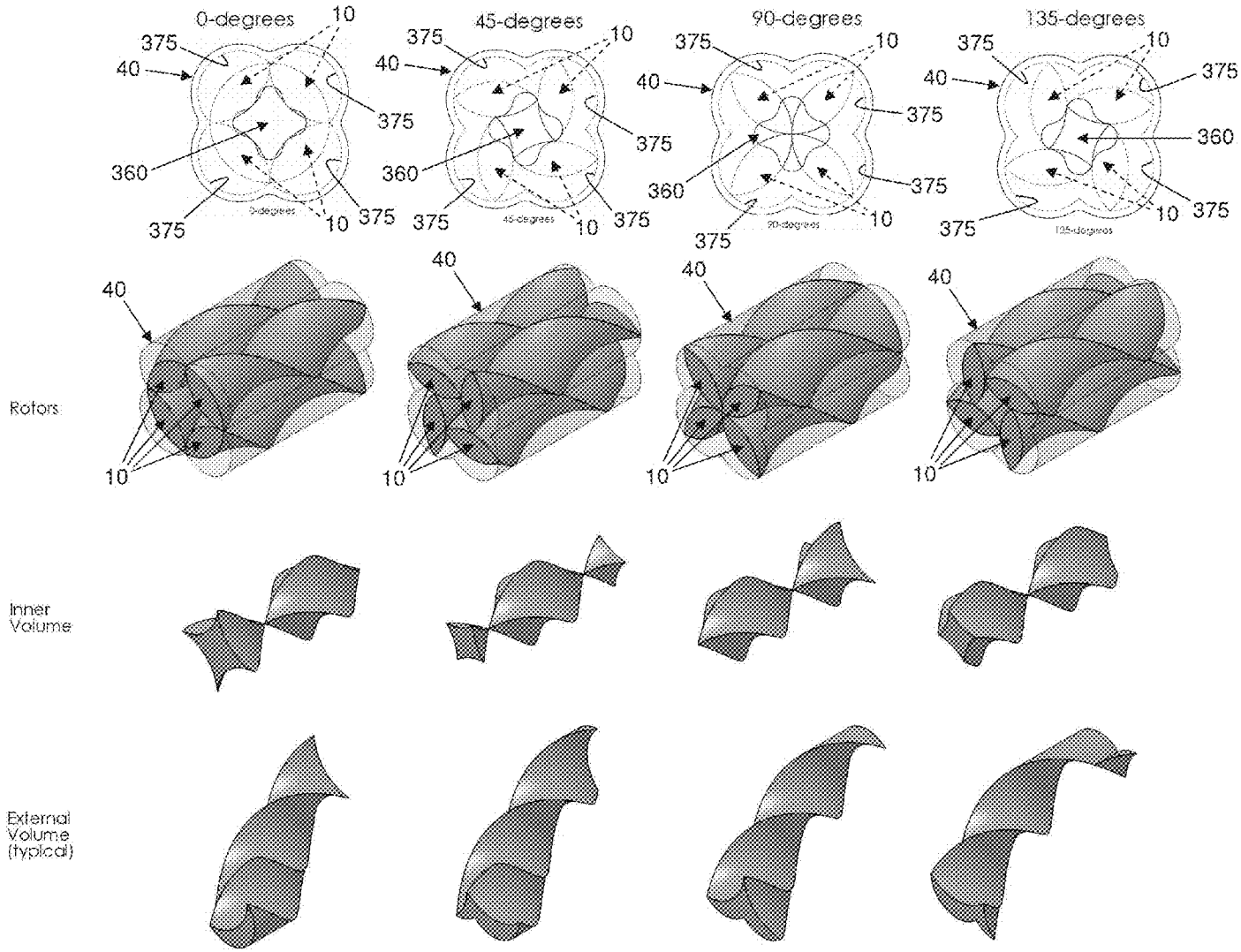
FIG. 16A is a schematic visualization, taken at stepped intervals of rotation (45 degrees), of (i) the inlet port of the pump, (ii) the rotors of the pump, (iii) the volume between the meshed, lobed rotors (i.e., the aforementioned axial progressing cavity), and (iv) the volumes defined between the exteriors of the rotors and the interior of the hollow housing (i.e., the aforementioned plurality of peripheral progressing cavities)

On account of the foregoing construction, it will be seen that when inlet port opening 360 is connected to a source of flowable matter (e.g., fluid), and rotational force is applied to drive coupling pulley 215, meshed, lobed rotors 10 will be caused to rotate, whereby to create (i) an axial progressing cavity between the meshed, lobed rotors, and (ii) a plurality of peripheral progressing cavities external to the meshed, lobes rotors, between the meshed, lobed rotors and the outer wall of the hollow housing. Thus, in the multi-channel, rotary, progressing cavity pump of the present invention, where N meshed lobed rotors are provided within the hollow housing, at least N+1 progressing cavities are created by rotation of the meshed lobed rotors within the hollow housing. These progressing cavities receive flowable matter (e.g., fluid) from inlet port opening 360 and provide a pumping capacity so as to eject the flowable matter out outlet port opening 340. See FIG. 16A, which is a visualization, taken at stepped intervals of rotation (45 degrees), of (i) inlet port 360 of the pump, (ii) the rotors 10 of the pump, (iii) the volume between the meshed, lobed rotors (i.e., the aforementioned axial progressing cavity), and (iv) the volumes defined between the exteriors of the rotors and the interior of hollow housing 40 (i.e., the aforementioned plurality of peripheral progressing cavities).

Significantly, because multi-channel, rotary, progressing cavity pump 220 comprises both an axial progressing cavity and a plurality of peripheral progressing cavities, the multi-channel, rotary, progressing cavity pump provides a pumping capacity significantly greater than that provided by a conventional rotary, progressing cavity pump (which lacks the plurality of peripheral progressing cavities of the present invention).

In one preferred form of the present invention, the inlet port 360 and the outlet port 340 each comprise a multi-lobe configuration, wherein the number of lobes 365 in the inlet port 360, and the number of lobes 345 in the outlet port 340, is equal to the number of lobed rotors 10 disposed within the hollow housing, and further wherein each lobe extends between two adjacent rotors 10, and communicates with the two adjacent overlapping cylindrical channels 375 which receive those rotors, whereby to facilitate the ingress of flowable matter into, and the egress of flowable matter out of, the plurality of peripheral progressing cavities, and hence improve the efficiency of the multi-channel, rotary, progressing cavity pump.

It should be noted that the provision of mechanical rotational energy is not limited to a belt-driven pulley and can be extended to other mechanical rotation energy means such as chain and sprockets, gears, friction couplings, viscous couplings, and magnetic couplings.

FIG. 17 shows a partial cross-sectional view of a slow flow pump 230 that comprises the top-level assembly of the second exemplary multi-channel, rotary, progressing cavity pump. This pump 230 is identical to the pump 220 discussed above except for the steeper pitched rotor lobe helix that results in a reduced flow rate pump for the equivalent input rotor velocity.

FIG. 18 shows a partial cross-sectional view of a compressor 240 that comprises the top-level assembly of the third exemplary multi-channel, rotary, progressing cavity pump. This pump 240 is identical to the pump 220 discussed above except for the variable pitch rotor lobe helix that results in a compression of the flow along the axial direction of the pump rotors.

Figure 19A:
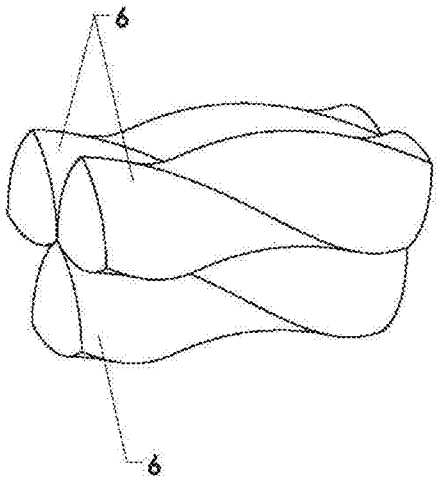
FIG. 19A is an axonometric projection view showing the meshing of multiple 3-lobe rotor body profiles for a multi-channel, rotary, progressing cavity pump of the present invention.
Figure 19B:
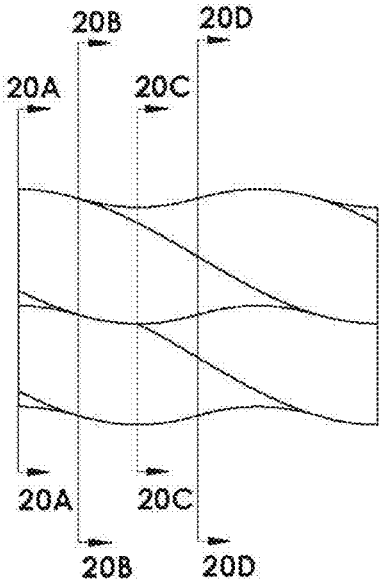
FIG. 19B is a side elevation view showing the meshing of the 3-lobed rotor profiles of FIG. 19A.
Figure 20A:
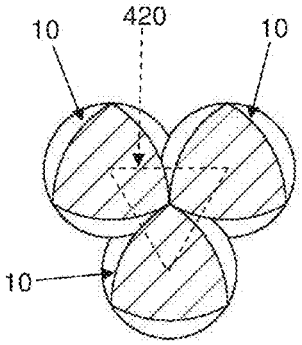
FIG. 20A is a cross-sectional view taken along line 20A-20A of FIG. 19B.
Figure 20B:
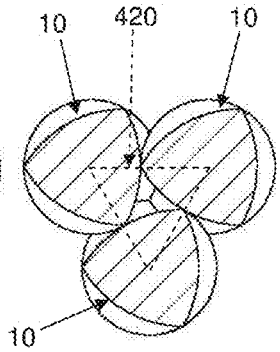
FIG. 20B is a cross-sectional view taken along line 20B-20B of FIG. 19B.
Figure 20C:
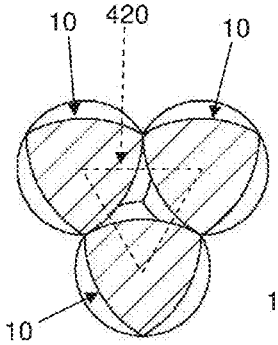
FIG. 20C is a cross-sectional view taken along line 20C-20C of FIG. 19B.
Figure 20D:
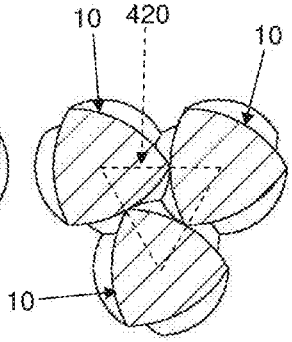
FIG. 20D is a cross-sectional view taken along line 20D-20D of FIG. 19B.

FIGS. 19A and 19B show the arrangement of a 3-lobe variant of synchronized meshing rotors for an analogous multi-channel, rotary, progressing cavity pump. The 3-lobed rotor body profile 6 is defined by three intersecting equal radius coplanar arcs that locate the center of each arc at the apex defined by the intersection of the other two remaining arcs such that the angle at each apex is 120 degrees. This region is extruded along the rotor axis about a primarily helical path to define the 3-lobed rotor variant. The position of the rotor axis for each rotor is located at the corners of a virtual triangle 420 (FIG. 20A) that is defined parallel to the end faces of the rotor. The size of the virtual triangle is defined such that the rotor apex circle of each rotor passes through the geometric center point of the triangle.

FIGS. 20A-20D show the cross-sectional views of the section lines detailed in FIG. 19B. The enclosed volume between the meshed rotors (i.e., the aforementioned axial progressing cavity) is manipulated through synchronous rotation of the rotors which results in a pumping action in the axial direction, and the enclosed volumes between each of the meshed rotors and their surrounding cylindrical chambers in the hollow housing (i.e., the aforementioned plurality of peripheral progressing cavities). It should be appreciated that the 3-lobe rotor variant design is translatable to the 2-lobe variant multi-channel, rotary, progressing cavity pump design with the rotor housing and block plates adapted to support and house three rotors instead of four rotors.

Use of the Apparatus to Generate Mechanical Energy

In the foregoing disclosure, the apparatus of the present invention is discussed in the context of converting mechanical input energy into material flow, i.e., rotary mechanical input energy supplied to drive coupling pulley 215 is used to turn meshed, lobed rotors 10 so as to pump flowable matter (e.g., a fluid). However, it should be appreciated that the apparatus of the present invention may also be used to generate mechanical output energy from an existing material flow. More particularly, in this form of the invention, inlet port opening 360 is connected to a source of flowing matter (e.g., a fluid), this flowing matter passes through hollow housing 40 causing meshed, lobed rotors 10 to rotate, whereby to turn drive coupling pulley 215. In this way, the apparatus of the present invention may be used to generate mechanical output energy from an existing material flow.

Modifications

It will be appreciated that still further embodiments of the present invention will be apparent to those skilled in the art in view of the present disclosure. It is to be understood that the present invention is by no means limited to the particular constructions herein disclosed and/or shown in the drawings, but also comprises any modifications or equivalents within the scope of the invention.

What is claimed is:

1. A multi-channel, rotary, progressing cavity pump, said multi-channel, rotary, progressing cavity pump comprising:

a hollow housing having an outer wall defined by a plurality of overlapping cylindrical chambers, a first end wall defining an inlet port, and a second end wall defining an outlet port, said inlet port and said outlet port communicating with each of said overlapping cylindrical chambers of said hollow housing;

a plurality of meshed, lobed rotors disposed within said hollow housing, wherein each rotor comprises a plurality of lobes, each lobe having first and second axially-facing end surfaces, said first and second axially-facing end surfaces defining a twist angle, and each lobe defining a helix angle;

each of said meshed, lobed rotors being disposed in one of said overlapping cylindrical chambers of said hollow housing so that a lobe apex sealingly engages the outer wall defined by its associated cylindrical chamber, and said first and second axially-facing end surfaces sealingly engage said first and second end walls, respectively;

wherein said inlet port and said outlet port are centered on the longitudinal axis of said hollow housing and each of said inlet port and said outlet port comprises a multi-lobe configuration, the number of lobes of said inlet port and said outlet port being equal to the number of meshed, lobed rotors disposed within said hollow housing, and each lobe of said inlet port and said outlet port extending between two adjacent meshed, lobed rotors and communicating with the adjacent overlapping cylindrical chambers which receive those two adjacent, meshed, lobed rotors;

whereby, when said meshed, lobed rotors are rotated in the same direction in unison, (i) an axial progressing cavity is created between said meshed, lobed rotors, and (ii) a plurality of peripheral progressing cavities are created external to said meshed, lobed rotors, between said meshed, lobed rotors and said outer wall of said hollow housing, the number of said plurality of peripheral progressing cavities being equal to the number of meshed, lobed rotors disposed within said hollow housing;

wherein the lobes of said inlet port and said outlet port extend between two adjacent meshed, lobed rotors such that the lobes of said inlet port and said outlet port are directly open to the peripheral progressing cavities created by two adjacent meshed, lobed rotors.

2. A multi-channel, rotary, progressing cavity pump according to claim 1 wherein, where N meshed lobed rotors are provided within said hollow housing, at least N+1 progressing cavities are created by rotation of said meshed lobed rotors within said hollow housing.

3. A multi-channel, rotary, progressing cavity pump according to claim 1 wherein each of said rotors comprises two lobes.

4. A multi-channel, rotary, progressing cavity pump according to claim 3 wherein said first and said second axially-facing surfaces define a twist angle of 270 degrees.

5. A multi-channel, rotary, progressing cavity pump according to claim 3 wherein said plurality of meshed, lobed rotors comprises four rotors.

6. A multi-channel, rotary, progressing cavity pump according to claim 3 wherein said hollow housing has an outer wall defined by four overlapping cylindrical chambers.

7. A multi-channel, rotary, progressing cavity pump according to claim 1 wherein each of said rotors comprises three lobes.

8. A multi-channel, rotary, progressing cavity pump according to claim 7 wherein said first and said second axially-facing surfaces define a twist angle of 90 degrees.

9. A multi-channel, rotary, progressing cavity pump according to claim 7 wherein said plurality of meshed, lobed rotors comprises three rotors.

10. A multi-channel, rotary, progressing cavity pump according to claim 7 wherein said hollow housing has an outer wall defined by three overlapping cylindrical chambers.

11. A multi-channel, rotary, progressing cavity pump according to claim 1 wherein said plurality of meshed, lobed rotors comprises four rotors, said inlet port comprises four lobes and said outlet port comprises four lobes.

12. A multi-channel, rotary, progressing cavity pump according to claim 1 wherein a rotor gear is secured to each of said rotors, and further wherein said rotor gears are turned in the same direction in unison by a ring gear.

13. A multi-channel, rotary, progressing cavity pump according to claim 1 wherein rotational energy is supplied to said rotors by at least one from the group consisting of a belt, a gear, a chain, a friction coupling, a viscous coupling, and a magnetic coupling.

14. A method for transporting flowable matter, the method comprising:

providing a multi-channel, rotary, progressing cavity pump, said multi-channel, rotary, progressing cavity pump comprising:

a hollow housing having an outer wall defined by a plurality of overlapping cylindrical chambers, a first end wall defining an inlet port, and a second end wall defining an outlet port, said inlet port and said outlet port communicating with each of said overlapping cylindrical chambers of said hollow housing;

a plurality of meshed, lobed rotors disposed within said hollow housing, wherein each rotor comprises a plurality of lobes, each lobe having first and second axially-facing end surfaces, said first and second axially-facing end surfaces defining a twist angle, and each lobe defining a helix angle;

each of said meshed, lobed rotors being disposed in one of said overlapping cylindrical chambers of said hollow housing so that a lobe apex sealingly engages the outer wall defined by its associated cylindrical chamber, and said first and second axially-facing end surfaces sealingly engage said first and second end walls, respectively;

wherein said inlet port and said outlet port are centered on the longitudinal axis of said hollow housing and each of said inlet port and said outlet port comprises a multi-lobe configuration, the number of lobes of said inlet port and said outlet port being equal to the number of meshed, lobed rotors disposed within said hollow housing, and each lobe of said inlet port and said outlet port extending between two adjacent meshed, lobed rotors and communicating with the adjacent overlapping cylindrical chambers which receive those two adjacent, meshed, lobed rotors;

whereby, when said meshed, lobed rotors are rotated in the same direction in unison, (i) an axial progressing cavity is created between said meshed, lobed rotors, and (ii) a plurality of peripheral progressing cavities are created external to said meshed, lobed rotors, between said meshed, lobed rotors and said outer wall of said hollow housing, the number of said plurality of peripheral progressing cavities being equal to the number of meshed, lobed rotors disposed within said hollow housing;

wherein the lobes of said inlet port and said outlet port extend between two adjacent meshed, lobed rotors such that the lobes of said inlet port and said outlet port are directly open to the peripheral progressing cavities created by two adjacent meshed, lobed rotors;

connecting said inlet port to a source of flowable matter; and rotating said meshed, lobed rotors in the same direction in unison.

15. A method according to claim 14 wherein, where N meshed lobed rotors are provided within said hollow housing, at least N+1 progressing cavities are created by rotation of said meshed lobed rotors within said hollow housing.

16. A method according to claim 14 wherein the flowable matter comprises a liquid.

17. A method according to claim 14 wherein the flowable matter comprises a gas.

18. A method according to claim 14 wherein the flowable matter comprises granules.

19. A method according to claim 14 wherein each of said rotors comprises two lobes.

20. A method according to claim 19 wherein said first and said second axially-facing surfaces define a twist angle of 270 degrees.

21. A method according to claim 19 wherein said plurality of meshed, lobed rotors comprises four rotors.

22. A method according to claim 19 wherein said hollow housing has an outer wall defined by four overlapping cylindrical chambers.

23. A method according to claim 14 wherein said plurality of meshed, lobed rotors comprises four rotors, said inlet port comprises four lobes and said outlet port comprises four lobes.

24. A method according to claim 14 wherein a rotor gear is secured to each of said rotors, and further wherein said rotor gears are turned in the same direction in unison by a ring gear.

25. A method according to claim 14 wherein rotational energy is supplied to said rotors by at least one from the group consisting of a belt, a gear, a chain, a friction coupling, a viscous coupling, and a magnetic coupling.

26. A multi-channel, rotary, progressing cavity generator, said multi-channel, rotary, progressing cavity generator comprising:

a hollow housing having an outer wall defined by a plurality of overlapping cylindrical chambers, a first end wall defining an inlet port, and a second end wall defining an outlet port, said inlet port and said outlet port communicating with each of said overlapping cylindrical chambers of said hollow housing;

a plurality of meshed, lobed rotors disposed within said hollow housing, wherein each rotor comprises a plurality of lobes, each lobe having first and second axially-facing end surfaces, said first and second axially-facing end surfaces defining a twist angle, and each lobe defining a helix angle;

each of said meshed, lobed rotors being disposed in one of said overlapping cylindrical chambers of said hollow housing so that a lobe apex sealingly engages the outer wall defined by its associated cylindrical chamber, and said first and second axially-facing end surfaces sealingly engage said first and second end walls, respectively;

wherein said inlet port and said outlet port are centered on the longitudinal axis of said hollow housing and each of said inlet port and said outlet port comprises a multi-lobe configuration, the number of lobes of said inlet port and said outlet port being equal to the number of meshed, lobed rotors disposed within said hollow housing, and each lobe of said inlet port and said outlet port extending between two adjacent meshed, lobed rotors and communicating with the adjacent overlapping cylindrical chambers which receive those two adjacent, meshed, lobed rotors;

said meshed, lobed rotors being configured to rotate in the same direction in unison so that (i) an axial progressing cavity is created between said meshed, lobed rotors, and (ii) a plurality of peripheral progressing cavities are created external to said meshed, lobed rotors, between said meshed, lobed rotors and said outer wall of said hollow housing, the number of said plurality of peripheral progressing cavities being equal to the number of meshed, lobed rotors disposed within said hollow housing;

wherein the lobes of said inlet port and said outlet port extend between two adjacent meshed, lobed rotors such that the lobes of said inlet port and said outlet port are directly open to the peripheral progressing cavities created by two adjacent meshed, lobed rotors;

such that when said inlet port is connected to a source of flowing matter, said meshed, lobed rotors will be turned so as to generate mechanical output energy.

27. A method for generating mechanical output energy from flowing matter, the method comprising:

providing a multi-channel, rotary, progressing cavity generator, said multi-channel, rotary, progressing cavity generator comprising:

a hollow housing having an outer wall defined by a plurality of overlapping cylindrical chambers, a first end wall defining an inlet port, and a second end wall defining an outlet port, said inlet port and said outlet port communicating with each of said overlapping cylindrical chambers of said hollow housing;

a plurality of meshed, lobed rotors disposed within said hollow housing, wherein each rotor comprises a plurality of lobes, each lobe having first and second axially-facing end surfaces, said first and second axially-facing end surfaces defining a twist angle, and each lobe defining a helix angle;

each of said meshed, lobed rotors being disposed in one of said overlapping cylindrical chambers of said hollow housing so that a lobe apex sealingly engages the outer wall defined by its associated cylindrical chamber, and said first and second axially-facing end surfaces sealingly engage said first and second end walls, respectively;

wherein said inlet port and said outlet port are centered on the longitudinal axis of said hollow housing and each of said inlet port and said outlet port comprises a multi-lobe configuration, the number of lobes of said inlet port and said outlet port being equal to the number of meshed, lobed rotors disposed within said hollow housing, and each lobe of said inlet port and said outlet port extending between two adjacent meshed, lobed rotors and communicating with the adjacent overlapping cylindrical chambers which receive those two adjacent, meshed, lobed rotors;

said meshed, lobed rotors being configured to rotate in the same direction in unison so that (i) an axial progressing cavity is created between said meshed, lobed rotors, and (ii) a plurality of peripheral progressing cavities are created external to said meshed, lobed rotors, between said meshed, lobed rotors and said outer wall of said hollow housing, the number of said plurality of peripheral progressing cavities being equal to the number of meshed, lobed rotors disposed within said hollow housing;

wherein the lobes of said inlet port and said outlet port extend between two adjacent meshed, lobed rotors such that the lobes of said inlet port and said outlet port are directly open to the peripheral progressing cavities created by two adjacent meshed, lobed rotors;

such that when said inlet port is connected to a source of flowing matter, said meshed, lobed rotors will be turned so as to generate mechanical output energy; and connecting said inlet port to a source of flowing matter so that said meshed, lobed rotors will be turned so as to generate mechanical output energy.

* * * * *